US005259211A

United States Patent [19]

Ikeda

[11] Patent Number: 5,259,211

[45] Date of Patent: Nov. 9, 1993

[54] METHOD FOR CONTROLLING THE ROTATIONAL SPEED OF A MOTOR-COMPRESSOR USED IN AN AIR CONDITIONER

[75] Inventor: Susumu Ikeda, Isesaki, Japan

[73] Assignee: Sanden Corporation, Gunma, Japan

[21] Appl. No.: 960,682

[22] Filed: Oct. 14, 1992

[30] Foreign Application Priority Data

Oct. 15, 1991 [JP] Japan ..... 3-266137

[51] Int. Cl.[5] ..... F25B 45/00

[52] U.S. Cl. ..... 62/228.4; 62/149; 62/163

[58] Field of Search ..... 62/228.4, 228.3, 149, 62/292, 161, 163, 213, 126, 129

[56] References Cited

U.S. PATENT DOCUMENTS 4,602,484 7/1986 Bendikson ..... 62/228.3 X
4,901,534 2/1990 Nakatsuno et al. ..... 62/228.4 X
5,119,071 6/1992 Takezawa et al. ..... 62/228.4 X

FOREIGN PATENT DOCUMENTS 0111152 4/1989 Japan ..... 62/163

*Primary Examiner*—Harry B. Tanner
*Attorney, Agent, or Firm*—Baker & Botts

[57] ABSTRACT

A method for controlling the rotational speed of a motor-compressor used in an air conditioner for vehicle is disclosed. The rotational speed of the motor-compressor is controlled via an inverter circuit. The motor-compressor is driven at a predetermined constant rotational speed only when a constant rotational speed command signal for controlling the rotational speed of the motor-compressor to the predetermined constant rotational speed is sent to the inverter circuit. When refrigerant is charged to the refrigerant circuit of the air conditioner, the rotational speed of the motor-compressor can be controlled to an optimum speed without being influenced by other unnecessary conditions.

8 Claims, 2 Drawing Sheets

METHOD FOR CONTROLLING THE ROTATIONAL SPEED OF A MOTOR-COMPRESSOR USED IN AN AIR CONDITIONER

BACKGROUND OF THE INVENTION

1. Field of the Invention

The present invention relates to a method for controlling the rotational speed of a motor-compressor used in an air conditioner for vehicles, and more particularly to a method for controlling the rotational speed of a motor-compressor via an inverter.

2. Description of the Prior Art

There are two types of systems which are used as air conditioners for vehicles. One is a system using a compressor driven by an engine of a vehicle via a belt, etc. The other is a system using a motor-compressor driven by an electric motor. In either type of system, refrigerant is not charged in the refrigerant circuit constituting the air conditioner before the air conditioner is attached to a vehicle. Refrigerant is charged into the refrigerant circuit after the air conditioner is attached to a vehicle and the refrigerant circuit is vacuumed.

When refrigerant is charged, in the case of the system using a compressor driven by an engine, the rotational speed of the compressor can be controlled to an appropriate rotational speed by controlling the rotational speed of the engine. In the case of the system using a motor-compressor, however, since the rotational speed of the compressor is controlled in accordance with the ambient temperature of the vehicle, an atmospheric condition, a set temperature of the air blown into the interior of the vehicle and so forth, the rotational speed of the compressor is not controlled to a constant speed. Therefore, the condition of the refrigerant charge is not stable.

In the system using a compressor driven by an engine, a proper amount of charged refrigerant can be determined by recognizing the amount of charged refrigerant through a sight glass provided in the refrigerant circuit. However, in the system using a motor-compressor, in a case where the system is started under a condition that the temperature of the interior of the vehicle is relatively high and the temperature of the air blown into the interior to be controlled is set to a relatively low temperature, the motor-compressor is driven at a high rotational speed. As a result, there is a concern that the refrigerant may be over charged.

Moreover, at a time immediately after charge of refrigerant is started, the refrigerant is sent into the refrigerant circuit, not by the motor-compressor, but by the pressure difference between the pressure in the refrigerant circuit and the pressure in a bottle of refrigerant so that the pressure in the refrigerant circuit reaches a saturated pressure. Therefore, if the motor-compressor is driven at a high rotational speed under a condition where the amount of refrigerant existing in the refrigerant circuit is small, the compressor portion of the motor-compressor may be damaged. On the contrary, if the motor-compressor is driven at a very low rotational speed or under a condition where the motor-compressor may be stopped from the relationship with various setting temperatures, it becomes impossible to charge refrigerant.

SUMMARY OF THE INVENTION

Accordingly, an object of the present invention is to provide a method for controlling the rotational speed of a motor-compressor used in an air conditioner for vehicles, which can freely control the rotational speed of the motor-compressor to an optimum speed without being influenced by the temperature of the interior of the vehicle, the atmosphere condition and the set temperature of the air blown into the interior.

Another object of the present invention is to provide a method for controlling the rotational speed of a motor-compressor used in an air conditioner for vehicles, which can control the drive of the motor-compressor such that the motor-compressor is not driven under a condition where the amount of refrigerant existing in a refrigerant circuit is small, thereby preventing damage of the compressor portion of the motor-compressor.

To achieve these objects, a method for controlling the rotational speed of a motor-compressor used in an air conditioner for vehicles is herein provided. The motor-compressor is driven by a motor and the rotational speed of the motor-compressor is controlled via an inverter circuit. The method for controlling the rotational speed of the motor-compressor comprises the steps of sending a plurality of signals for determining the driving condition of the air conditioner to the inverter circuit, one of the plurality of signals being a constant rotational speed command signal for controlling the rotational speed of the motor-compressor to a predetermined constant rotational speed, and driving the motor-compressor at the predetermined constant rotational speed only when the constant rotational speed command signal is sent to a switching element module.

Alternatively, the method for controlling the rotational speed of the motor-compressor comprises the steps of sending a plurality of signals for determining the driving condition of the air conditioner to the inverter circuit, one of the plurality of signals being a constant rotational speed command signal for controlling the rotational speed of the motor-compressor to a predetermined constant rotational speed; sending a plurality of sensor signals from a plurality of sensors for sensing the state of the air conditioner and the environmental state thereof to a control unit, one of the plurality of sensor signals being a pressure signal sent from a pressure sensor provided in a refrigerant circuit forming the air conditioner; and determining whether to drive the motor-compressor at the predetermined constant rotational speed in accordance with the constant rotational speed command signal and the pressure signal.

In the control method according to the present invention, after the motor-compressor is attached to the air conditioner for vehicles, the motor-compressor can be driven at an optimum rotational speed regardless of conditions set in a driving condition setting unit of the air conditioner. Therefore, it is not necessary to adjust the rotational speed of the motor-compressor when refrigerant is charged. Further, a failure to charge refrigerant does not occur.

Moreover, in the control method according to the present invention, over charge of refrigerant, which occurs by driving the motor-compressor at a rotational speed more than a necessary speed, can be effectively prevented.

Furthermore, when the amount of refrigerant present in the refrigerant circuit is smaller than a predetermined amount, the motor-compressor can be controlled not to be driven by the control for driving the motor-compressor at the predetermined constant rotational speed only when the pressure signal from the pressure sensor represents a pressure not lower than a predetermined pressure and the constant rotational speed command signal is sent to the inverter circuit. Therefore, damage to the motor-compressor, which occurs when the motor-compressor is driven under a condition where refrigerant does not exist in the refrigerant circuit or the amount of refrigerant present in the refrigerant circuit is very small, can be prevented.

Preferred exemplary embodiments of the invention will now be described with reference to the accompanying drawings which are given by way of example only, and are not intended to limit the present invention.

DETAILED DESCRIPTION OF THE PREFERRED EMBODIMENTS OF THE INVENTION

Figure 1:
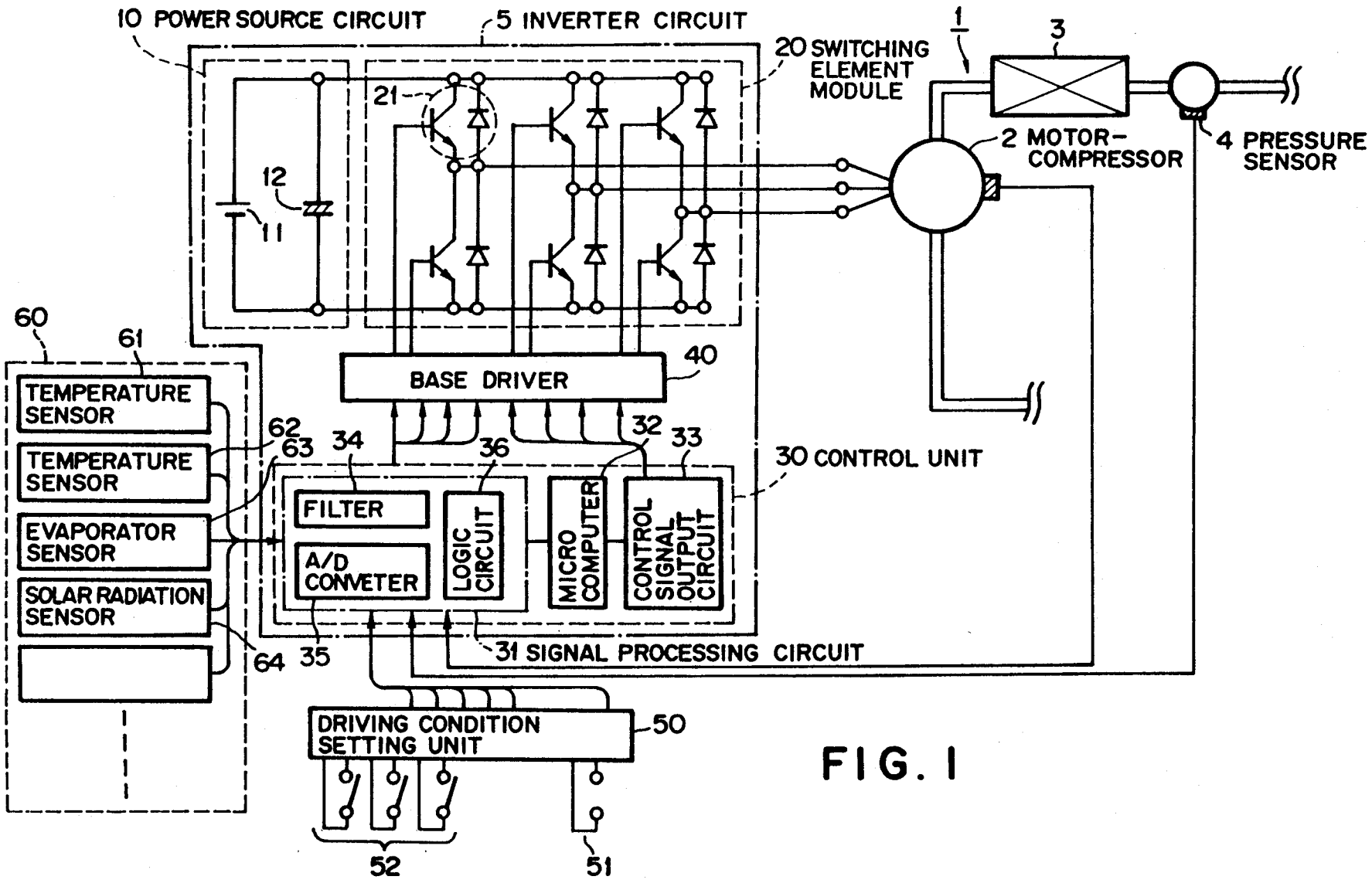
FIG. 1 is a schematic diagram of a system for carrying out a control method according to an embodiment of the present invention.

FIG. 1 illustrates a system for an air conditioner for vehicles which uses a motor-compressor, for carrying out a control method according to an embodiment of the present invention. In FIG. 1, refrigerant circuit 1 for an air conditioner for vehicles comprises a motor-compressor 2 driven by a motor (not shown), a condenser 3 and a pressure sensor 4. Inverter circuit 5 for controlling the rotational speed of motor-compressor 2 is coupled to the motor-compressor 2. Inverter circuit 5 comprises a DC power source circuit 10, a switching element module 20 having a plurality of switching elements 21, a base driver 40 and a control unit 30 for controlling the switching timing of the switching elements. DC power source circuit 10 includes a DC power source 11 and a capacitor 12. DC power source circuit 10 is coupled to switching element module 20, and the switching element module is coupled to motor-compressor 2. Control unit 30 is coupled to switching element module 20 via base driver 40.

Control unit 30 has a signal processing circuit 31, a micro computer 32 and a control signal output circuit 33. Control unit 30 outputs a signal for controlling the switching timing of switching elements 21 in switching element module 20. Signal processing circuit 31 comprises a filter 34, an A/D converter 35 and a logic circuit 36. Control unit 30 is coupled to motor-compressor 2, pressure sensor 4, driving condition setting unit 50 and a group of sensors 60 other than the pressure sensor. The group of sensors 60 includes various sensors such as temperature sensor 61 for the interior of the vehicle, temperature sensor 62 for the atmosphere, evaporator sensor 63, solar radiation sensor 64, etc. Driving condition setting unit 50 has a switch 51 for a constant rotational speed command signal and various switches 52 for setting the signals sent to control unit 30 for comparing them with the signals sent from the plurality of sensors 61, 62, 63, 64, . . . A constant rotational speed of motor-compressor 2 is preset in driving condition setting unit 50, and the signal of the constant rotational speed is output to control unit 30 as the constant rotational speed command signal by turning constant rotational speed command signal switch 51 on.

Pressure sensor 4 senses a pressure in refrigerant circuit 1, and sends the signal to control unit 30 as a pressure sensor signal. When the pressure sensor signal and the constant rotational speed command signal are sent to control unit 30, the control unit determines whether to carry out the control of driving motor-compressor 2 at the constant rotational speed. After the determination, control unit 30 sends a driving signal of motor-compressor 2 to base driver 40. Base driver 40 drives switching element module 20 in accordance with the driving signal sent from control unit 30. Switching element module 20 switches each of switching elements 21 based upon the signal sent from base driver 40, and controls the rotational speed of motor-compressor 2.

Figure 2:
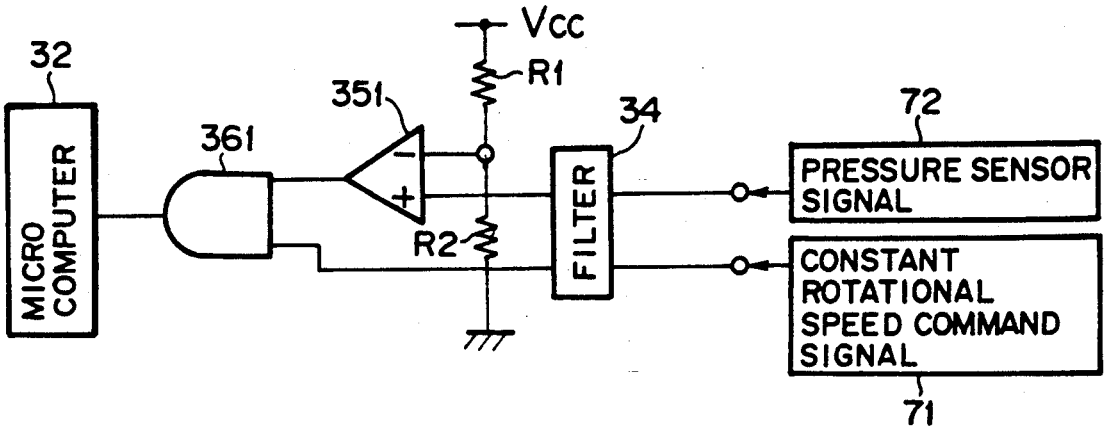
FIG. 2 is a circuit diagram of a part of a control unit of the system shown in FIG. 1.

FIG. 2 illustrates a part of the circuit of control unit 30. Constant rotational speed command signal 71 sent from driving condition setting unit 50 is sent to AND circuit 361 through filter 34. Pressure sensor signal 72 sent from pressure sensor is sent to comparator 351 through filter 34. In comparator 351, the voltage level of pressure sensor signal 72 is compared with the voltage level of a predetermined pressure signal which is preset by dividing a base voltage Vcc by resistances R1 and R2. The result of the comparison is sent to AND circuit 361. Comparator 351 outputs a logical signal "1" when pressure sensor signal 72 sent from pressure sensor 4 is not less than the predetermined pressure signal, and outputs a logical signal "0" for other conditions. AND circuit 361 outputs a logical signal "1" only when constant rotational speed command signal 71 is sent (i.e., the logical signal is "1") and the logical signal from comparator 351 is "1".

In the above system, only when constant rotational speed command signal 71 is sent and the amount of refrigerant present in refrigerant circuit 1 indicated by pressure sensor signal 72 sent from pressure sensor 4 is not less than a predetermined amount, control unit 30 outputs the driving signal for driving motor-compressor 2 at a predetermined constant rotational speed. When constant rotational speed command signal 71 is not output, the driving of motor-compressor 2 at a predetermined constant rotational speed is not carried out. Further, when the amount of refrigerant present in refrigerant circuit 1 is smaller than the predetermined amount, the logical signal output from comparator 351 is "0" and AND circuit 361 outputs a logical signal "0". In such a case, control unit 30 controls base driver 40 so as not to drive motor-compressor 2.

Figure 3:
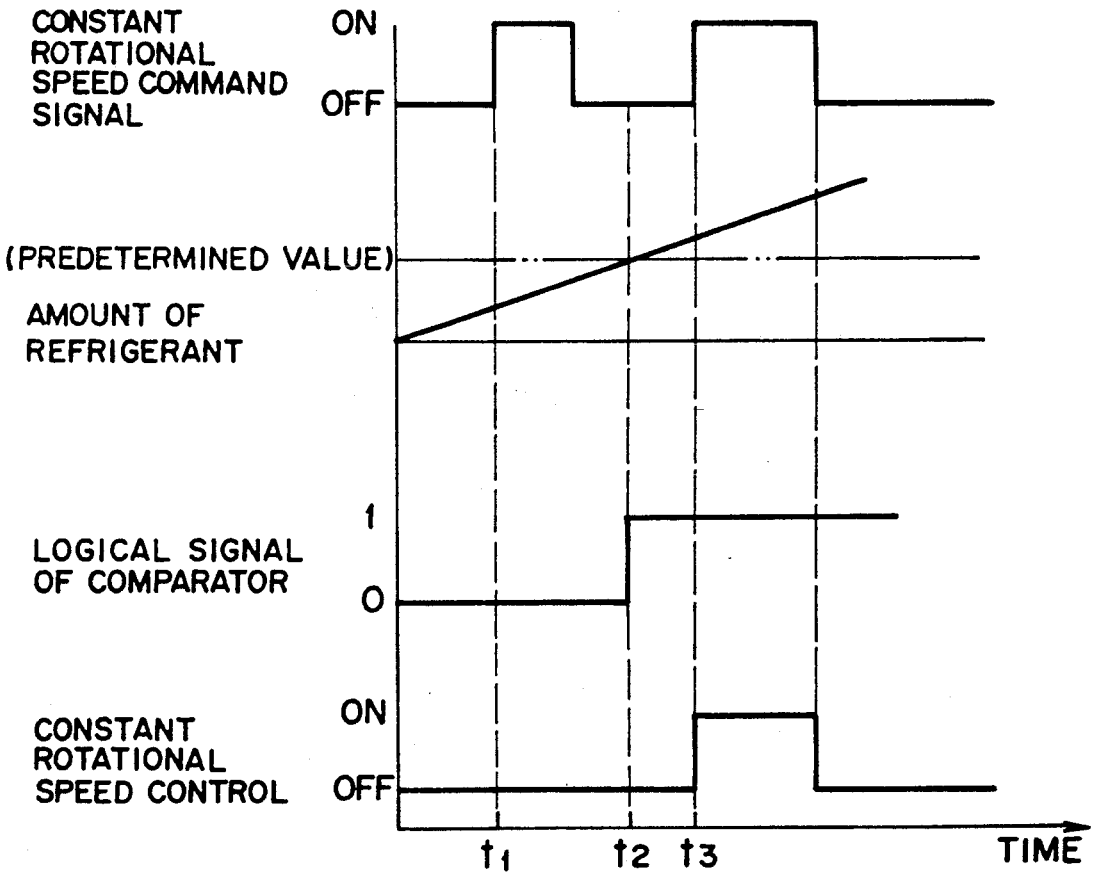
FIG. 3 is a time chart showing the control operation of the system shown in FIG. 1.

FIG. 3 illustrates a time chart showing the control operation described above. In FIG. 3, at a time t1, since the constant rotational speed command signal is output but the the pressure sensor signal indicates that the amount of refrigerant present in refrigerant circuit 1 has not reached a predetermined value and comparator 351 does not output logical signal "1", the control of constant rotational speed is not carried out. At a time t2, since the amount of refrigerant present in refrigerant circuit 1 has reached a predetermined value and comparator 351 outputs logical signal "1" but the constant rotational speed command signal is not output, the control of constant rotational speed is not carried out. At a time t3, since the constant rotational speed command signal is output and the amount of refrigerant present in refrigerant circuit 1 has reached a predetermined value and comparator 351 outputs logical signal "1", the control of constant rotational speed is carried out. Thus, when the amount of refrigerant present in refrigerant circuit 1 is small, motor-compressor 2 is not driven, and damage to the compression portion of the motor-compressor can be prevented.

Although the pressure sensor signal from pressure sensor 4 is utilized for the control for driving motor-compressor 2 in the above embodiment, the control for driving motor-compressor 2 at a constant rotational speed can be conducted even without the pressure sensor signal. For example, motor-compressor 2 may be driven at a constant rotational speed only when a constant rotational speed command signal is sent to a control unit. By such a method, motor-compressor 2 can be driven at a freely predetermined constant rotational speed regardless of various other conditions. In order to prevent damage to the compression portion of the motor-compressor due to driving when the amount of refrigerant present in refrigerant circuit 1 is small, another sensor may be employed for detecting such a condition.

Although several preferred embodiments of the present invention have been described in detail herein, it will be appreciated by those skilled in the art that various modifications can be made without materially departing from the novel and advantageous teachings of the invention. Accordingly, the embodiments disclosed herein are by way of example. The scope of the invention is defined by the claims annexed hereto and which form a part of this application.

What is claimed is:

1. A method for controlling the rotational speed of a motor-compressor used in an air conditioner for vehicles, wherein said motor-compressor is driven by a motor and the rotational speed of said motor-compressor is controlled via an inverter circuit, said method comprising the steps of:

sending a plurality of signals for determining a driving condition of said air conditioner to said inverter circuit, one of the plurality of signals being a constant rotational speed command signal for controlling the rotational speed of said motor-compressor to a predetermined constant rotational speed; and driving said motor compressor at said predetermined constant rotational speed only when said constant rotational speed command signal is sent to a switching element module.

2. The method as recited in claim 1 wherein said switching element module comprises a plurality of switching elements and said inverter circuit comprises a DC power source, said switching element module, and a control unit for controlling said switching elements.

3. The method as recited in claim 2 wherein said plurality of signals for determining the driving condition of said air conditioner are provided to said control unit of said inverter circuit.

4. A method for controlling the rotational speed of a motor-compressor used in an air conditioner for vehicles, wherein a refrigerant circuit contains refrigerant under pressure, said motor-compressor is driven by a motor, and the rotational speed of said motor-compressor is controlled via an inverter circuit, said method comprising the steps of:

sending a plurality of signals for determining a driving condition of said air conditioner to said inverter circuit, one of the plurality of signals being a constant rotational speed command signal for controlling the rotational speed of said motor compressor to a predetermined constant rotational speed;

sending a plurality of sensor signals from a plurality of sensors for sensing states of operation of said air conditioner and environmental states thereof to a control unit, one of the plurality of sensor signals being a pressure signal sent from a pressure sensor provided in said refrigeration circuit comprising a portion of said air conditioner; and determining whether to drive said motor-compressor at said predetermined constant rotational speed in accordance with said constant rotational speed and said pressure signal.

5. The method as recited in claim 4 wherein said motor-compressor is driven at said predetermined constant rotational speed only when said pressure signal represents a pressure greater than or equal to a predetermined pressure and said constant rotational speed command signal is sent to said control unit.

6. The method as recited in claim 4 wherein said inverter circuit comprises a DC power source and a switching element module comprising a plurality of switching elements and wherein said control unit for controls said switching elements.

7. A method for controlling the rotational speed of a motor-compressor used in an air conditioner for vehicles, wherein a refrigerant circuit contains refrigerant under pressure, said motor-compressor is driven by a motor, and the rotational speed of said motor-compressor is controlled via an inverter circuit, which comprises a control unit and a switching element module, said method comprising the steps of:

sending a plurality of signals for determining a driving condition of said air conditioner to said control unit, said plurality of signals including a constant rotational speed command signal for controlling the rotational speed of said motor compressor to a predetermined constant rotational speed and a pressure signal which is sent from a pressure sensor provided in said refrigeration circuit comprising a portion of said air conditioner;

comparing said pressure signal and a predetermined value and sending said predetermined constant rotational speed signal to said switching element module when said pressure signal is greater than or equal to the predetermined value;

driving said motor compressor at said predetermined constant rotational speed only when said constant rotational speed command signal is sent to said switching element module.

8. The method as recited in claim 7 wherein said switching element module comprises a plurality of switching elements and said control unit controls said switching elements and wherein said inverter circuit further comprises a DC power source.

* * * * *